United States Patent [19]

Towns et al.

[11] Patent Number: 4,792,053

[45] Date of Patent: Dec. 20, 1988

[54] TAMPER-INDICATING CAPPED CONTAINER WITH ANGULARLY MOVABLE TINE

[75] Inventors: Edward J. Towns, Convent Station; Edward M. Brown, Livingston, both of N.J.; William M. Lester, Del Ray Beach, Fla.

[73] Assignee: TBL Development Corporation, Livingston, N.J.

[21] Appl. No.: 441,112

[22] Filed: Nov. 12, 1982

[51] Int. Cl.[4] ..... B65D 53/04

[52] U.S. Cl. ..... 215/250; 215/350; 220/214; 220/278; 220/377

[58] Field of Search ..... 215/203, 209, 211, 213, 215/214, 219, 220, 230, 232, 247, 250, 252, 257, 258, 341, 343, 344, 347, 349, 350, 351, 329, 365, 366; 116/306, 307, 200, 212; 73/762; 49/13; 270/214, 258, 304, 359, 278, 277, 377

[56] References Cited

U.S. PATENT DOCUMENTS

| | | | |
|---|---|---|---|
| 603,151 | 4/1898 | Norton . | |
| 810,334 | 1/1906 | Green . | |
| 939,602 | 11/1909 | Landon . | |
| 1,095,313 | 5/1914 | Davids . | |
| 1,916,977 | 7/1933 | Gutman | 215/329 |
| 2,068,389 | 1/1937 | Smith | 215/350 |
| 2,090,555 | 8/1937 | Sharp . | |
| 2,131,774 | 10/1938 | Waring | 215/250 |
| 2,131,775 | 10/1938 | Waring | 215/250 |
| 3,489,307 | 1/1970 | Wenger | 215/351 X |
| 3,501,042 | 3/1970 | Risch et al. | 215/232 |
| 3,692,199 | 9/1972 | Mumford | 215/220 |
| 3,826,221 | 7/1974 | Ross . | |
| 3,896,959 | 7/1975 | Roy | 215/350 X |
| 3,899,295 | 8/1975 | Halpern . | |
| 3,923,198 | 12/1975 | Brochman | 220/359 |
| 4,069,935 | 1/1978 | Hampel | 215/203 |
| 4,270,665 | 6/1981 | Kunimoto et al. | 215/347 |
| 4,381,840 | 5/1983 | Ostrowsky | 215/329 |
| 4,456,139 | 6/1984 | Kent | 215/252 |
| 4,461,389 | 7/1984 | Korn | 215/246 |

*Primary Examiner*—Stephen Marcus
*Assistant Examiner*—Bryon Gehman
*Attorney, Agent, or Firm*—Robin, Blecker & Daley

[57] ABSTRACT

A tamper-indicating capped container includes an indicating member sealed across the container access port and the container cap is transparent and has capability for effecting visible change in the indicating member selectively in the course of container-opening sense movement of the cap. Tines may depend in cantilever manner from the cap interior to provide for tearing of the indicating member and the indicating member may be paper sheet material or a color change telltale.

16 Claims, 2 Drawing Sheets

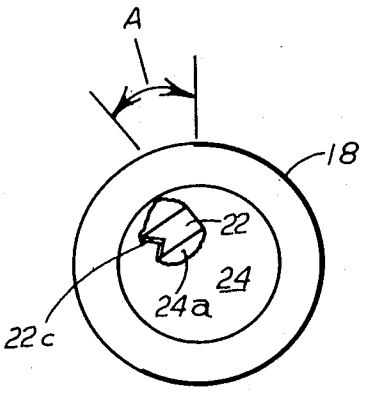
FIG. 4
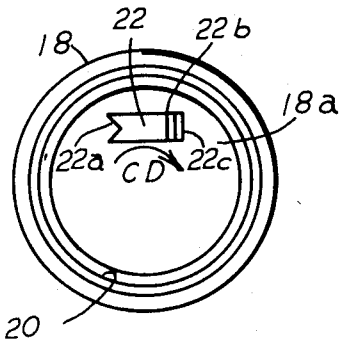
FIG. 2
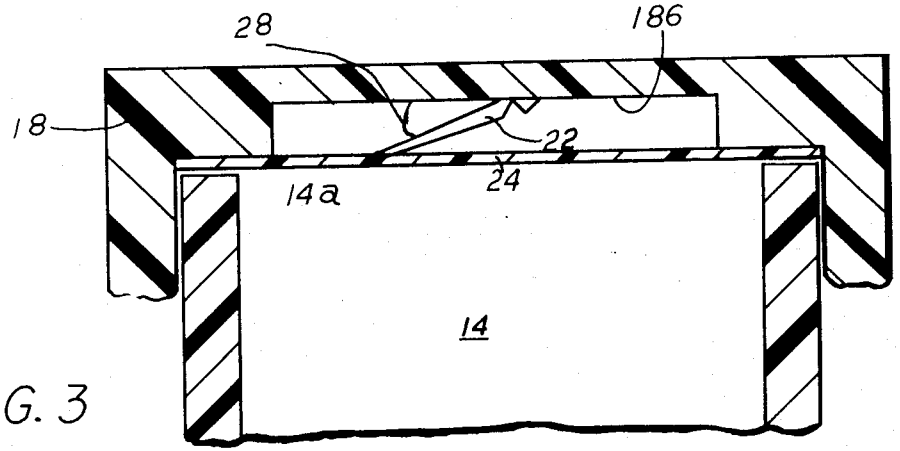
FIG. 3
FIG. 1
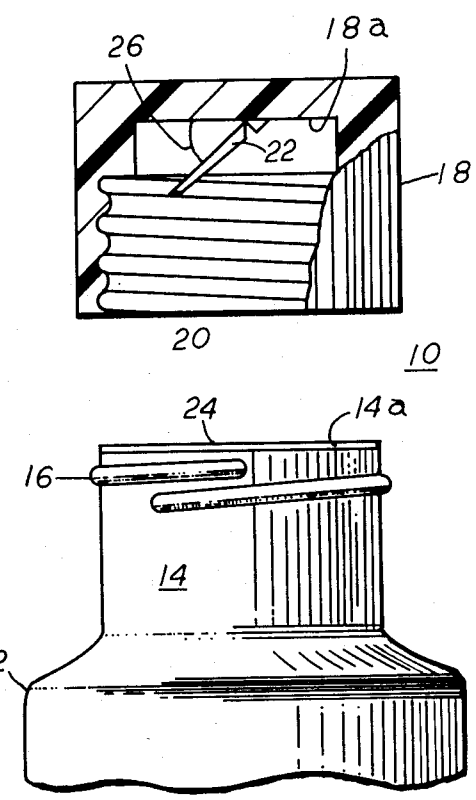

TAMPER-INDICATING CAPPED CONTAINER WITH ANGULARLY MOVABLE TINE

FIELD OF THE INVENTION

This invention relates generally to containers and closures therefor and pertains more particularly to a container providing indication to a user that the container has been tampered with.

BACKGROUND OF THE INVENTION

Recent domestic events have heightened the need for an effective manner in which to assure the uncontaminated delivery of contained products to a consumer, particularly medicinal products taken internally. Specifically needed is the provision of a container for such products which bears assuring indication to the consumer that the contents have not been tampered with from their point of manufacture to the point of consumer sale.

In one prior art approach toward meeting this need, use is made of so-called "telltale" indication, i.e., a readily discernible characteristic indicative of tampering, such as a visible sign that some person has previously attempted to gain access to the container contents. Broadly speaking, these efforts may be generalized as placing a tamper-indicating member, e.g., an ambient-sensitive element, in the path of access to a container to indicate tampering by discernible change, e.g., change of color of the member. A quite early example of this practice is seen in U.S. Pat. No. 1,095,313 wherein a light-sensitive label is applied to a bottle and the releasably capped bottle with such label is wrapped in a light-impermeable paper. When the wrapper is removed in ambient light, the label changes color and indication is thus provided to a subsequent purchaser that the wrapper has previously been removed. In a practice within the last decade, seen in U.S. Pat. No. 3,899,295, this technique is modernized by including the telltale substance as an interiorly disposed protected component of the wrapper. In the '295 patent, a heat-shrinkable member straddles both the cap and container vessel after capping and has a pH-sensitive integrity indicia imprinted on the interior of the member, the indicia being packaged with a basic gaseous material which maintains the indicia of a given first color. When the heat-shrinkable member is first removed from the cap and vessel, ambient pH causes the indicia to change color.

Another telltale approach is seen in situations in which containers are not releasably capped, i.e., the telltale is a component of a strippable closure member. Examples of this effort are seen in U.S. Pat. No. 3,826,221 and 3,923,198. In the '198 patent, a multilayer member serves to close the access avenue to a container and includes a layer which becomes opaque when subjected to stress. A color backing or printed legend normally visible through the stress-sensitive layer is not seen on tampering, thus providing a color change which is discernible to the user to indicate that tampering has occurred. In the '221 patent, an outer seal is adhesively secured to a container as a closure member and includes an ink which smudges if the closure member is tampered with.

In applicants' view, the latter approach is more desirable in one aspect than the former, since the latter provides indication of tampering directly at the access port rather than at a preceding wrapper removal stage.

Thus, the heat-shrinkable member discussed above is a stage removed from the removal of the cap of the container and may not be present at the cap removal. However, such advantage in the latter techniques is obtained at the expense of exposing the telltale to inadvertent activating stress in the course of handling and shipping. It is applicant's further view that tamper indication should be effectively provided without need for such ambient-sensitive telltales or that more effective such ambient-sensitive telltale containers should be afforded to manufacturers.

SUMMARY OF THE INVENTION

This invention has as its primary object the provision of improved tamper indication for containers of the capped type.

A secondary object of the invention is to provide improved tamper-indicating containers of the ambient-sensitive telltale type.

In attaining these and other objects, applicants provide a container having a jar with a mouth for access to its contents, a telltale element, preferably in the form of a simple paper seal closing the mouth, and a cap releasably securable to the jar and circumscribing its mouth and the telltale element when secured to the jar. The cap includes means depending interiorly from the cap top undersurface and orientated so as to travel in first sense upon the telltale element without rupturing same and to rupture the telltale element upon travel in opposite sense.

Such cap depending means may take the form of one or more knife-like tines or other rupturing elements cantilever-supported by the cap for flexure selectively in such first sense travel thereof, which is the clockwise closing rotation of the cap at the point of initial closure of the container and its contents at the point of manufacture. The cap is desirably made of transparent material such that the condition of the telltale element may be viewed constantly after the initial assembly juncture and to the point of consumer sale.

Where the telltale is of the ambient-sensitive variety, it may be in the form of an assembly including a first layer adhered to the mouth, an ambient-sensitive telltale second layer atop the first layer and a third layer protectively overlying the telltale layer and adhesively secured to the first layer. The third layer is rupturable selectively in the course of such cap second sense movement, thereby activating the telltale second layer.

The foregoing and other features of the invention will be further evident from the following detailed description of preferred embodiments and practices and from the drawings thereof wherein like reference numerals identify like parts throughout.

DESCRIPTION OF THE DRAWINGS

FIG. 1 is an exploded front elevation of the jar and cap of one embodiment of a container in accordance with the invention, the cap being broken away in part to show interior detail.

FIG. 2 is a bottom plan elevation of the cap of FIG. 1.

FIG. 3 is an enlarged central sectional view of the FIG. 1 container upon initial assembly of the cap with the sealed jar thereof.

FIG. 4 is a plan view of the assembly of FIG. 3 upon counterclockwise rotation of the cap relative to the jar.

DESCRIPTION OF PREFERRED EMBODIMENTS AND PRACTICES

Figure 8:
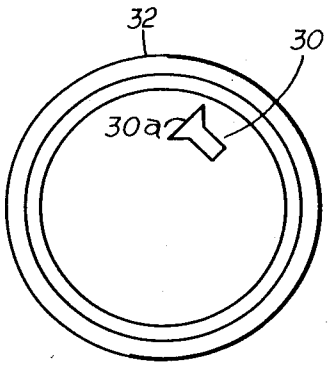
FIG. 8 is a bottom plan elevation of another embodiment of a cap usable in practicing the invention.

Referring to FIGS. 1 and 2, container 10 includes a vessel 12 of plastic or glass for such use as containing medicinal capsules or liquid, neck 14 of the jar being provided with closure threads 16 and terminating in open circular access opening or mouth 14*a*. Closure member or cap 18 is of rigid plastic material and is interiorly threaded at 20 for releasable securement to neck 14. In selecting plastic materials for jar 12, one looks to such thermoplastics as will provide a barrier to penetration, such as by use of a hypodermic needle. High impact styrene is suitable. As for cap 18, optically clear plastics of butyrate, acetate, nylon, lucite and plexiglass and the like are suitable.

Tine 22, which may be one or more in number, is formed integrally with cap 18, e.g., is molded therewith, and is cantilever-supported from cap undersurface 18*a*. As is seen in the underview of cap 18 in FIG. 2, the tine is elongate and is so disposed that its longitudinal axis is generally tangential to the radius of the cap. The tine extends from cap undersurface 18*a* such that the free tine end 22*a* trails the tine end 22*b*, which is in undersurface 18*a*, in the container closing direction of rotation of cap 18, such direction being indicated by arrow CD in FIG. 2.

Telltale seal 24 is secured to mouth 14*a* of jar 14 after the jar is loaded at the point of manufacture with its contents. Seal 24 is preferably comprised of paper sheet, e.g., wax paper, heat bondable or otherwise strongly securable to jar 14.

In FIG. 3, cap 18 is shown following its initial securement to jar 12, i.e., the cap having been rotated clockwise (first sense movement) fully into closely nested relation with seal 24. Based upon the foregoing orientation of tine 22 relative to the direction CD (FIG. 2) of closure rotation, the free end 22*a* of the tine rides upon seal 24 i.e., travels relative thereto, and the tine flexes into continually decreasing acute angular relation in the cap undersurface in the course of closure rotation. Thus, initial tine angle 26 of FIG. 1 decreases to final tine angle 28 of FIG. 3, as permitted by the cantilever disposition of tine 22. To this juncture, no component of force is presented to seal 24 which would rupture same. Conversely, opening rotation of cap 14, i.e., counterclockwise rotation thereof (second opposite sense movement) through angle A as seen in FIG. 4, gives rise to rupture of seal 24 in area 24*a* thereof as free end 22*a* of tine 22, and more particularly chamfered surface 22*c* (FIG. 4), bites directly into the seal. There results a tearing of seal 24, which is directly visible through transparent cap 18. Reverse bending of the tine is resisted by stop 22*c* (FIG. 2), which also functions to abuttingly sustain the seal tearing or rupturing action.

Figure 6:
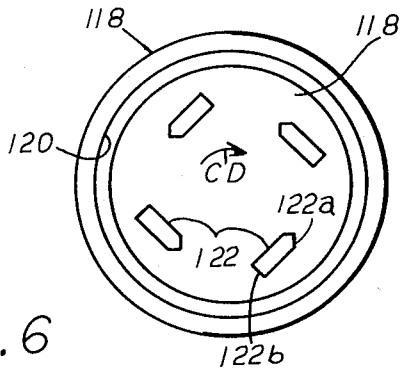
FIG. 6 is a bottom plan elevation of the cap of FIG. 5.
Figure 7:
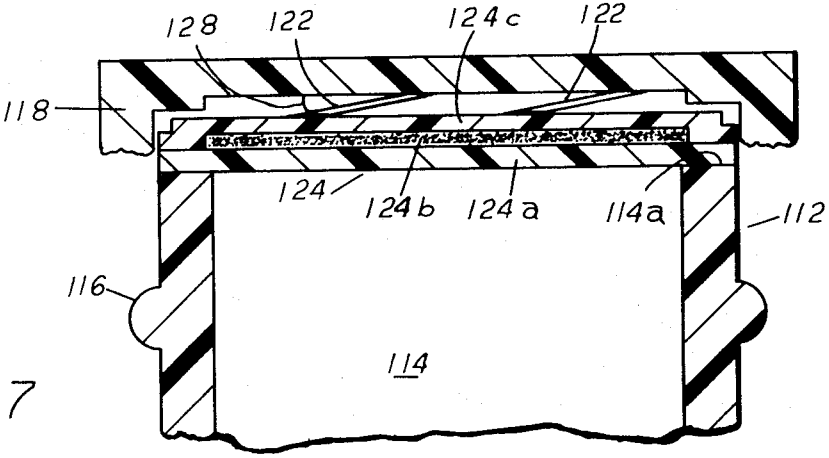
FIG. 7 is an enlarged central sectional view of the FIG. 5 container upon initial assembly of the cap with the sealed jar thereof.
Figure 5:
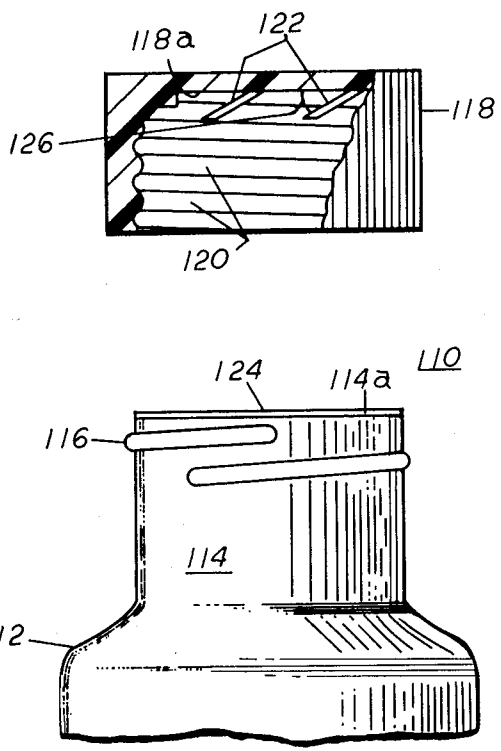
FIG. 5 is an exploded front elevation of the jar and cap of another embodiment of a container in accordance with the invention, the cap being broken away in part to show interior detail.

Referring now to the container 110 embodiment shown in FIGS. 5–7, telltale assembly 124 is sealably secured to mouth 114*c* of jar 112 after the jar is loaded at the point of manufacture with its contents. In FIG. 6, tines 122 are again elongate with their longitudinal axes tangential to the cap radius and have free ends 122*a* leading ends 122*b* thereof, such free ends 122*a* tapering to a point. As is seen in FIG. 7, telltale assembly 124, which may be a multilayer laminated unit, includes a first or lowermost layer 124*a*, comprised of plastic sheet material, e.g., polyethylene, heat bondable or otherwise strongly securable to jar 112. A telltale layer 124*b* is disposed atop layer 124*a* as a second or intermediate layer of the assembly. This layer includes therein ambient-sensitive matter, such as the color-changing pH-sensitive substances set forth in the aforementioned '295 patent and like known materials, i.e., any substance which will be of first sensible character when protected from the ambient environment and of second different sensible character when exposed to the ambient environment. A third or uppermost layer 124*c*, e.g., optically clear Mylar, is in overlying relation to layer 124*b* and is lightly adhesively secured to first layer 124*a* as indicated, peripherally outwardly of layer 124*b*.

In FIG. 7, cap 118 is shown following its initial securement to jar 112, i.e., the cap having been rotated clockwise (first sense movement) fully into closely nested relation with assembly 124, the tine angles being reduced acute angles (128) again as contrasted with their measure (126) in FIG. 5. As in the container of FIGS. 1–4, to this juncture, no component of force is presented to layer 124*c* which would rupture same. Conversely, opening rotation of cap 118, i.e., counterclockwise rotation thereof (second opposite sense movement) gives rise to rupture of layer 124*c* as free ends 122*a* of tines 122 bite directly into the layer. There results an activation of layer 124*b* by its exposure to the ambient environment and a discernible indication, such as color change or the visualization of an integrity indicia disposed in or below layer 124*b* on the surface of layer 124*a*. In order to indicate that tampering has not occurred prior to the consumer's own activation of layer 124*b*, cap 118 and its integrally molded tines, and layer 124*c* are of transparent material to permit direct viewing of the condition of the telltale.

The invention contemplates, in the FIGS. 5–7 embodiment, a substantially stronger adhesive force as between layer 124*a* and jar mount 114*a* than the adhesive force existing between layer 124*c* and the surface to which it is secured, e.g., the perimeter of layer 124*a*. With this relation among the adhesive forces, the would-be tamperer will find it quite difficult to remove the entire laminate assembly 124 without activating layer 124*b*. Layer 124*c* may fully circumscribe layer 124*a* and engage jar mouth 114 at a location below assembly 124 to further defeat tampering. Also, layer 124*b* may be stress-opacifying in character. Further, a code number or like reference indicium may be imprinted on layer 124 for control purposes.

A further alternative tine configuration is shown in FIG. 8, wherein tine 30 of cap 32 is shaped as a putty knife, outwardly tapering to a straight edge at tine free end 30*a*. As will be also noted, the tines may be employed in redundant fashion, i.e., in plural number as in FIG. 6, or singly as in FIGS. 2 and 8.

Various changes in structure and modifications in practice may evidently be introduced in the foregoing particularly disclosed and described embodiments and practices without departing from the invention. Thus, such matters as container and cap configuration, tine structure, telltale selection, and the like will be seen to be readily varied. The preferred embodiments and practices are thus intended in an illustrative and not in a limiting sense. The true spirit and scope of the invention is set forth in the following claims.

We claim:

1. A tamper-indicating container comprising:

(a) a vessel for article containment and having an access opening:

(b) a closure member having means for supporting said closure member for first sense rotative movement relative to said vessel into securement therewith and in circumscribing relation to said access opening of said vessel and for second different rotative sense movement for release from such securement, said closure member providing visibility therethrough;

(c) sealing means in secured relation to said access opening for closing same and including a telltale and;

(d) means depending from an upper interior surface of said closure member and inaccessible therethrough for travel with said closure member relative to said telltale in engaged non-rupturing relation to said telltale in the course of said closure member first sense movement and for travel with said closure member in engaged rupturing relation to said telltale in the course of said closure member second different sense movement.

2. The container claimed in claim 1 wherein said means (d) comprises at least one sealing means rupturing element supported in said closure member for movement from first angular relation thereto to succeeding lesser angular relation thereto in the course of said first sense closure member movement.

3. The container claimed in claim 2 wherein said rupturing element is radially offset from the center of such closure member movements.

4. The container claim in claim 2 wherein said rupturing element is a cantilever-supported element depending from an interior surface of said closure member.

5. The container claimed in claim 4 wherein said cantilever-supported element is an elongate element secured to said closure member interior surface and orientated with its longitudinal axis substantially tangential to a radius of such closure member movements.

6. The container claimed in claim 4 wherein said cantilever-supported element is integral with said closure member.

7. The container claimed in claim 1 wherein said sealing means comprises a rupturable sheet secured to said vessel across said access opening thereof.

8. The container claimed in claim 1 wherein said sealing means comprises a multilayer assembly having a first layer secured to said vessel adjacent said access opening thereof, a second layer overlying said first layer and comprising means responsive to preselected environmental change to provide sensible indication of such change, and a third layer overlying said second layer and protecting same from environmental change, said third layer being disposed in the path of movement of said means (d).

9. The container claimed in claim 8 wherein said first layer is adhesively secured to said vessel and wherein said third layer is adhesively secured to either of said first layer or said vessel, the force of adhesion provided for said first layer exceeding the force of adhesion provided for said third layer.

10. A container closure comprising:

(a) a closure member having means for supporting said closure member for first sense rotative movement relative to a container into securement therewith and in circumscribing relation to an access opening of said container and for second different rotative sense movement for release from such securement, said closure member providing visibility therethrough; and (b) means dependent from an upper interior surface of said closure member and inaccessible therethrough for travel with said closure member and supported for deflection relative to said closure member in said first sense rotative movement of said closure and having orientation relative to said closure member for such deflection in said first sense movement of said closure member and for tearing a sealing member disposed across said container access opening in the course of said second different sense rotative movement of said closure member.

11. The closure claimed in claim 10 wherein said means (b) comprises at least one sealing member rupturing element supported in said closure member for movement from first angular relation thereto to succeeding lesser angular relation thereto in the course of said first sense closure member movement.

12. The closure claimed in claim 11 wherein said rupturing element is radially offset from the center of such closure member movements.

13. The closure claimed in claim 11 wherein said rupturing element is a cantilever-supported element depending from an interior surface of said closure member.

14. The closure claimed in claim 13 wherein said cantilever-supported element is an elongate element secured to said closure member interior surface and orientated with its longitudinal axis substantially tangential to a radius of such closure member movements.

15. The closure claimed in claim 13 wherein said cantilever-supported element is integral with said closure member.

16. The closure claimed in claim 10 wherein plural such cantilever-supported elements are equally mutually spaced in said closure member.

* * * * *